US012270546B2

(12) United States Patent
Ganiger et al.

(10) Patent No.: US 12,270,546 B2
(45) Date of Patent: Apr. 8, 2025

(54) DOME-DEFLECTOR ASSEMBLY FOR A COMBUSTOR OF A GAS TURBINE

(71) Applicant: General Electric Company, Schenectady, NY (US)

(72) Inventors: Ravindra Shankar Ganiger, Bengaluru (IN); Hiranya Nath, Bengaluru (IN); Asim Ghosal, Bengaluru (IN); Sripathi Mohan, Bengaluru (IN); Nageswar Ganji, Bengaluru (IN)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 18/324,313

(22) Filed: May 26, 2023

(65) Prior Publication Data

US 2024/0247803 A1 Jul. 25, 2024

(30) Foreign Application Priority Data

Jan. 19, 2023 (IN) ..... 202311003780

(51) Int. Cl.
*F23R 3/14* (2006.01)
*F23R 3/00* (2006.01)
*F23R 3/60* (2006.01)

(52) U.S. Cl.
CPC ..... *F23R 3/14* (2013.01); *F23R 3/002* (2013.01); *F23R 3/60* (2013.01)

(58) Field of Classification Search
CPC ..... F23R 3/002; F23R 2900/00005; F23R 2900/03041; F23R 2900/03042
See application file for complete search history.

(56) References Cited

U.S. PATENT DOCUMENTS

| | | | | |
|---|---|---|---|---|
| 5,271,219 | A | 12/1993 | Richardson | |
| 6,497,105 | B1 * | 12/2002 | Stastny | F23R 3/283 60/740 |
| 6,751,961 | B2 * | 6/2004 | Pacheco-Tougas | F23R 3/002 60/754 |
| 8,418,470 | B2 | 4/2013 | Burd | |
| 9,322,560 | B2 | 4/2016 | Erbas-Sen et al. | |
| 9,377,198 | B2 | 6/2016 | Eastwood et al. | |
| 9,518,738 | B2 | 12/2016 | Gerendas | |
| 9,534,786 | B2 | 1/2017 | Sreekanth et al. | |
| 9,625,152 | B2 | 4/2017 | Papple et al. | |
| 10,851,996 | B2 * | 12/2020 | DeBruhl | F23R 3/002 |
| 11,221,143 | B2 | 1/2022 | Stevens et al. | |
| 2008/0066468 | A1 * | 3/2008 | Faulder | F23R 3/10 60/737 |

(Continued)

*Primary Examiner* — Arun Goyal
*Assistant Examiner* — Henry Ng
(74) *Attorney, Agent, or Firm* — Venable LLP; Edward A. Kmett; Michele V. Frank

(57) ABSTRACT

A dome-deflector assembly for a combustor of a gas turbine includes a dome portion having a dome-side swirler opening therethrough, and a deflector portion having a deflector-side swirler opening therethrough. The dome portion and the deflector portion are connected together to form a dome-deflector cavity therebetween. The deflector portion includes a first-side surface and a second-side surface, the second-side surface being arranged within the dome-deflector cavity, and the second-side surface including a plurality of stress-relief contours arranged in a pattern about the deflector-side swirler opening.

8 Claims, 15 Drawing Sheets

(56) References Cited

U.S. PATENT DOCUMENTS

| | | | | |
|---|---|---|---|---|
| 2008/0115506 | A1* | 5/2008 | Patel | F23R 3/002 60/804 |
| 2015/0033746 | A1* | 2/2015 | Carey | F23R 3/10 60/722 |
| 2015/0096302 | A1* | 4/2015 | Herborth | F23R 3/002 60/752 |
| 2015/0135720 | A1* | 5/2015 | Papple | F23R 3/50 60/759 |
| 2015/0323185 | A1* | 11/2015 | Silkowski | F23R 3/12 415/208.5 |
| 2016/0169522 | A1* | 6/2016 | Cunha | F23R 3/283 60/740 |
| 2019/0063749 | A1* | 2/2019 | Zelesky | F02C 7/12 |
| 2020/0025383 | A1* | 1/2020 | Dord | F02C 3/04 |
| 2023/0324047 | A1* | 10/2023 | Sukumar | F23R 3/002 60/695 |

* cited by examiner

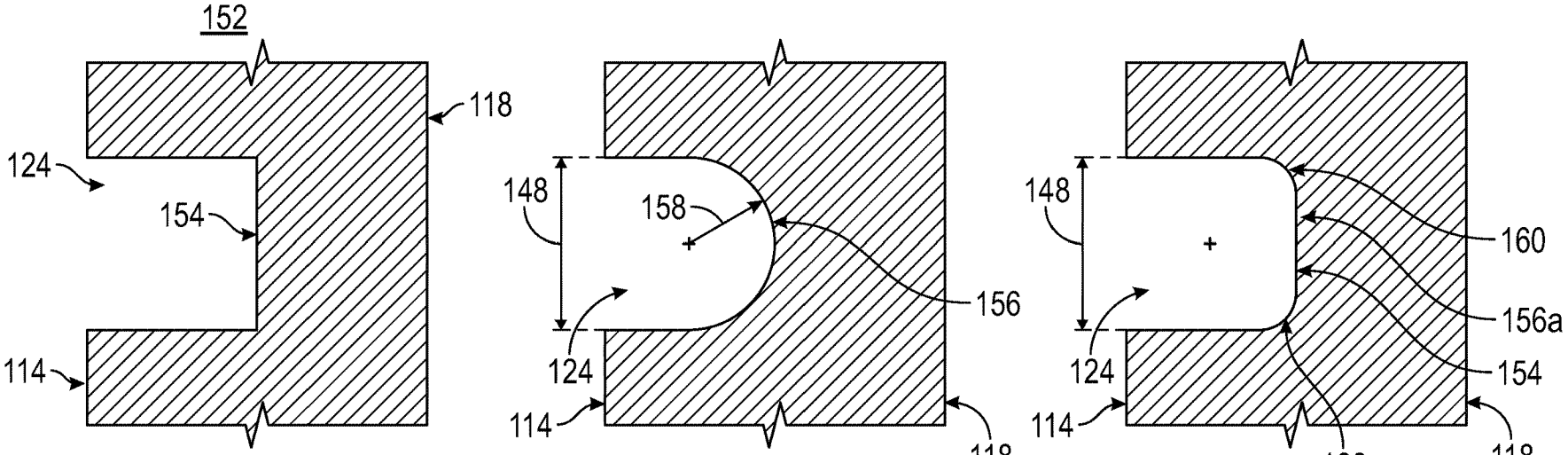
FIG. 7A
FIG. 7B
FIG. 7C
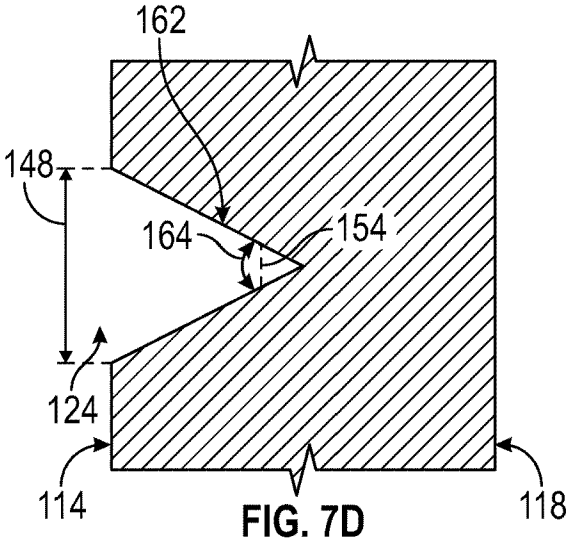
FIG. 7D

DOME-DEFLECTOR ASSEMBLY FOR A COMBUSTOR OF A GAS TURBINE

CROSS REFERENCE TO RELATED APPLICATIONS

The present application claims the benefit of Indian Patent Application No. 202311003780, filed on Jan. 19, 2023, which is hereby incorporated by reference herein in its entirety.

TECHNICAL FIELD

The present disclosure relates to a dome-deflector assembly for a combustor of a gas turbine engine.

BACKGROUND

Gas turbine engines are known to include a combustor that has a dome assembly extending around the combustor. The dome assembly, that may include a dome and a deflector, generally provides separation between an air plenum upstream of the dome assembly, and a combustion chamber downstream of the dome assembly. A plurality of mixer assemblies are included in the combustor, and each mixer assembly extends through the dome assembly to provide a fuel-air mixture into a combustion chamber adjacent to the dome assembly.

BRIEF DESCRIPTION OF THE DRAWINGS

Features and advantages of the present disclosure will be apparent from the following description of various exemplary embodiments, as illustrated in the accompanying drawings, wherein like reference numbers generally indicate identical, functionally similar, and/or structurally similar elements.

FIG. 7A is an enlarged cross-sectional view of a third circular groove, taken at detail view 152 of FIG. 6, according to an aspect of the present disclosure.

FIG. 7B depicts a cross-sectional view of an alternate arrangement of the third circular groove to that shown in FIG. 7A, according to an aspect of the present disclosure.

FIG. 7C depicts a cross-sectional view of another alternate arrangement of the third circular groove 124 to that shown in FIG. 7A, according to another aspect of the present disclosure.

FIG. 7D depicts a cross-sectional view of another alternate arrangement of the third circular groove to that shown in FIG. 7A, according to another aspect of the present disclosure.

DETAILED DESCRIPTION

Features, advantages, and embodiments of the present disclosure are set forth, or apparent from, a consideration of the following detailed description, drawings, and claims. Moreover, the following detailed description is exemplary and intended to provide further explanation without limiting the scope of the disclosure as claimed.

Various embodiments are discussed in detail below. While specific embodiments are discussed, this is done for illustration purposes only. A person skilled in the relevant art will recognize that other components and configurations may be used without departing from the spirit and the scope of the present disclosure.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Gas turbine engines are known to include a combustor that has a dome assembly extending around the combustor. The dome assembly, which may include a dome and a deflector connected together, generally provides separation between an air plenum upstream of the dome assembly, and a combustion chamber downstream of the dome assembly. The deflector may be provided on the combustion chamber side of the dome assembly and a cavity may be provided between the dome and the deflector to provide impingement cooling to the deflector. The dome may include airflow passages therethrough that are arranged to provide a flow of the air within the cavity. The deflector may include airflow passages to provide a flow of air from the cavity to the combustion chamber side of the deflector for impingement cooling of the hot surface side of the deflector. Heat-related stress in the deflector material may generally be seen in the deflector, particularly around connectors (e.g., bolts) that connect the deflector to the dome assembly. The heat-related stress of the deflector material may result in cracks or other degradation of the deflector, particularly around the connectors.

The present disclosure addresses the foregoing by providing a dome-deflector assembly in which the deflector includes stress-relief contours, such as grooves, on a cold-surface side of the deflector. More particularly, a plurality of contours (grooves) may be included in the cold-surface side of the deflector so as to provide better flexibility of heat-related expansion and contraction of the deflector so as to provide heat-related stress relief to the deflector.

Figure 1:
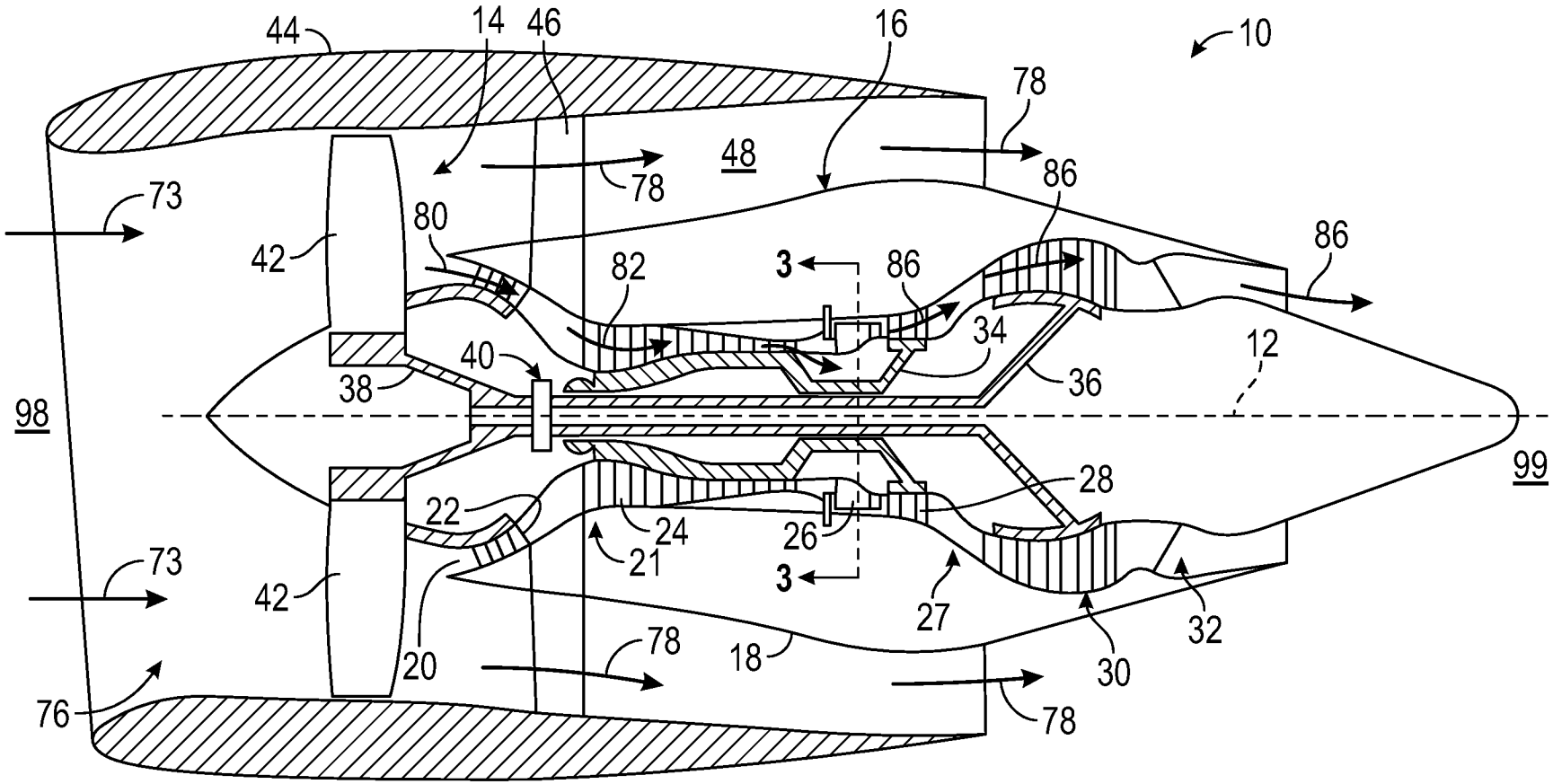
FIG. 1 is a schematic partial cross-sectional side view of an exemplary high by-pass turbofan jet engine, according to an aspect of the present disclosure.

Referring now to the drawings, FIG. 1 is a schematic partial cross-sectional side view of an exemplary high by-pass turbofan jet engine 10 as may incorporate various aspects of the present disclosure. Although further described below with reference to a ducted turbofan engine, the present disclosure is also applicable to turbomachinery in general, including turbojet, turboprop, and turboshaft gas turbine engines, including marine turbine engines, industrial turbine engines, and auxiliary power units. In addition, the present disclosure is not limited to ducted fan type turbine engines, such as that shown in FIG. 1, but, can be implemented in unducted fan (UDF) type turbine engines. As shown in FIG. 1, engine 10 has an axial centerline axis 12 that extends therethrough from an upstream end 98 to a downstream end 99 for reference purposes. In general, engine 10 may include a fan assembly 14 and a core engine 16 disposed downstream from the fan assembly 14.

The core engine 16 may generally include an outer casing 18 that defines an annular inlet 20 for providing a flow of inlet air to the core engine 16. The outer casing 18 encases, or at least partially forms, in serial flow relationship, a compressor section 21 having a low pressure (LP) compressor 22 and a high pressure (HP) compressor 24, a combustor 26, a turbine section 27 including a high pressure (HP) turbine 28 and a low pressure (LP) turbine 30, and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14 by way of a reduction gear 40, such as in an indirect-drive or a geared-drive configuration.

As shown in FIG. 1, the fan assembly 14 includes a plurality of fan blades 42 that are coupled to, and that extend radially outwardly from, the fan shaft 38. An annular fan casing or a nacelle 44 circumferentially surrounds the fan assembly 14 and/or at least a portion of the core engine 16. In one aspect, the nacelle 44 may be supported relative to the core engine 16 by a plurality of circumferentially spaced outlet guide vanes or struts 46. Moreover, at least a portion of the nacelle 44 may extend over an outer portion of the core engine 16 so as to define a bypass airflow passage 48 therebetween.

Figure 2:
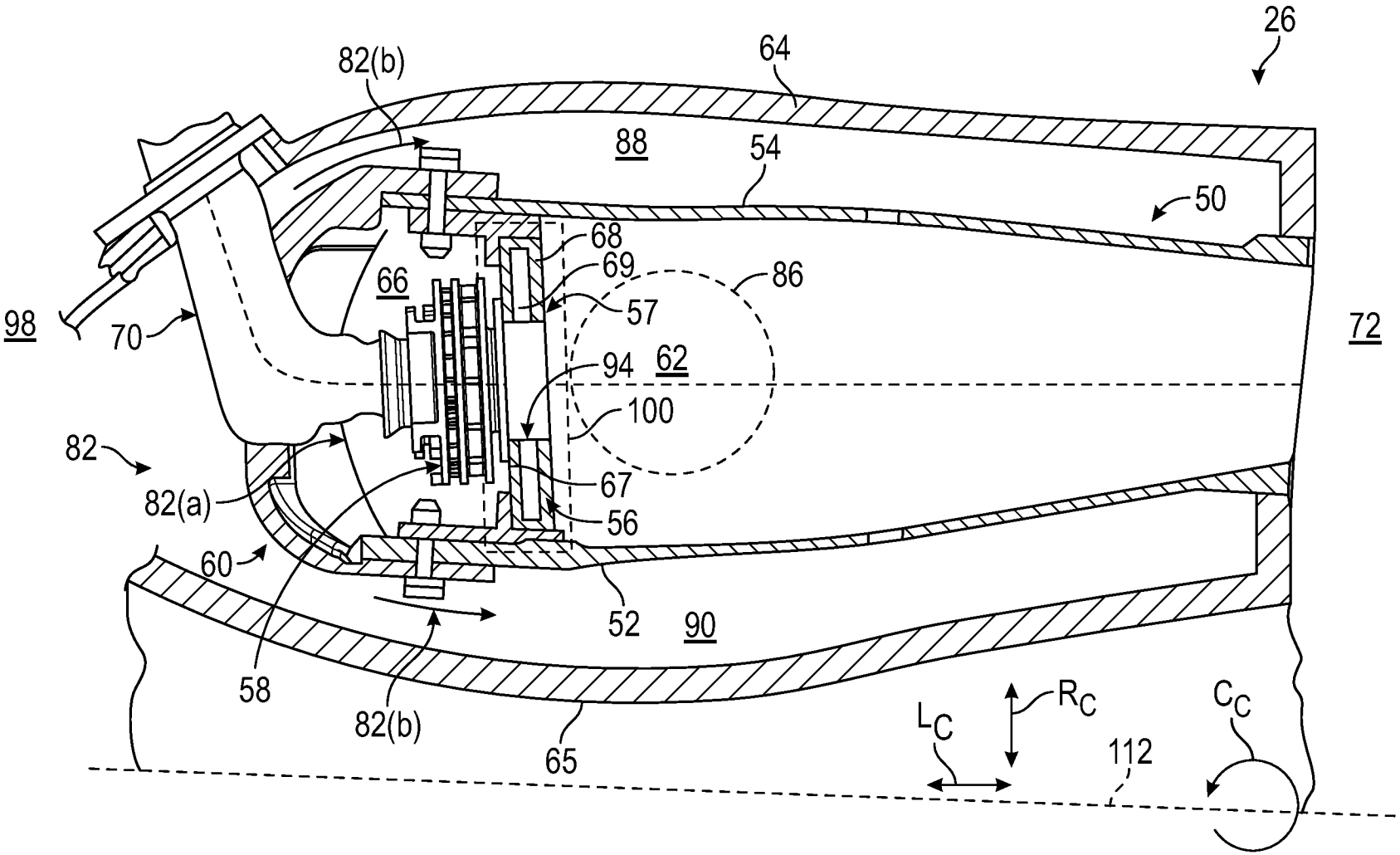
FIG. 2 is a partial cross-sectional side view of an exemplary combustor, according to an aspect of the present disclosure.

FIG. 2 is a cross-sectional side view of an exemplary combustor 26 of the core engine 16 as shown in FIG. 1. FIG. 2 depicts a combustor axial centerline 112 that may generally correspond to the engine axial centerline axis 12. Thus, the combustor 26 of FIG. 2 defines a combustor longitudinal direction ($L_C$) corresponding to the combustor axial centerline 112, a combustor radial direction ($R_C$) extending outward from the combustor axial centerline 112, and a combustor circumferential direction ($C_C$) extending circumferentially about the combustor axial centerline 112. As shown in FIG. 2, the combustor 26 may generally include a combustor liner 50, having an inner liner 52 and an outer liner 54 that are connected to a cowl 60. Each of the inner liner 52 and the outer liner 54 may be an annular liner that extends circumferentially about the combustor axial centerline 112. A dome 56 extends in the combustor radial direction $R_C$ between the inner liner 52 and the outer liner 54, and also extends circumferentially about the combustor axial centerline 112. The inner liner 52 and the outer liner 54 are spaced apart by the dome 56. The dome 56 can be connected to, mounted to, or otherwise operably coupled to the cowl 60. The dome 56 may include a plurality of dome-deflector assemblies 57 (to be described in more detail below) that include a dome portion 67, a deflector portion 68, and a dome-deflector cavity 69 defined between the dome portion 67 and the deflector portion 68. Together, the inner liner 52, the outer liner 54, and the dome 56 define a combustion chamber 62 therebetween. In the combustion chamber 62, an initial chemical reaction of an ignited fuel-oxidizer mixture injected into the combustion chamber 62 by a swirler assembly 58 may occur to generate combustion gases 86 within the combustion chamber 62. The combustion gases 86 then flow further downstream through the combustion chamber 62 into the HP turbine 28 and the LP turbine 30 (FIG. 1) via a turbine nozzle 72 at a downstream end of the combustion chamber 62. While FIG. 2 depicts a single swirler assembly 58, a plurality of the swirler assemblies 58 are present in the combustor 26, where the respective swirler assemblies 58 are circumferentially spaced apart from one another about the combustor axial centerline 112.

The combustor 26 further includes an outer casing 64 that extends circumferentially about the combustor axial centerline 112, and an inner casing 65 that also extends circumferentially about the combustor axial centerline 112. The outer casing 64 is spaced radially outward with respect to the combustor axial centerline 112 of the outer liner 54, and the inner casing 65 is spaced radially inward with respect to the combustor axial centerline 112 of the inner liner 52. An outer flow passage 88 is defined between the outer casing 64 and the outer liner 54, and an inner flow passage 90 is defined between the inner casing 65 and the inner liner 52.

Referring to FIG. 1 and FIG. 2 collectively, in operation, air 73 enters the nacelle 44 at a nacelle inlet 76, and a portion of the air 73 enters the annular inlet 20 to the compressor section 21 as a compressor inlet air flow 80, where it is compressed to form compressed air 82. Another portion of the air 73 is propelled by the fan assembly 14 and enters the bypass airflow passage 48, thereby providing a bypass airflow 78 to provide the main thrust source for the engine 10. In FIG. 2, the compressed air 82 from the compressor section 21 enters the combustor 26 via a diffuser (not shown). A portion of the compressed air 82, shown schematically as compressed air 82(*a*), enters the cowl 60 into a pressure plenum 66 therewithin, while another portion of the compressed air 82, shown schematically as compressed air 82(*b*), passes to the outer flow passage 88 and to the inner flow passage 90. The compressed air 82(*a*) in the pressure plenum 66 passes through the swirler assembly 58 to mix with fuel that is injected by a fuel nozzle assembly 70 to the swirler assembly 58 to form a fuel-oxidizer mixture (not shown) that is then ignited and burned in the combustion chamber 62 to generate the combustion gases 86.

Figure 3:
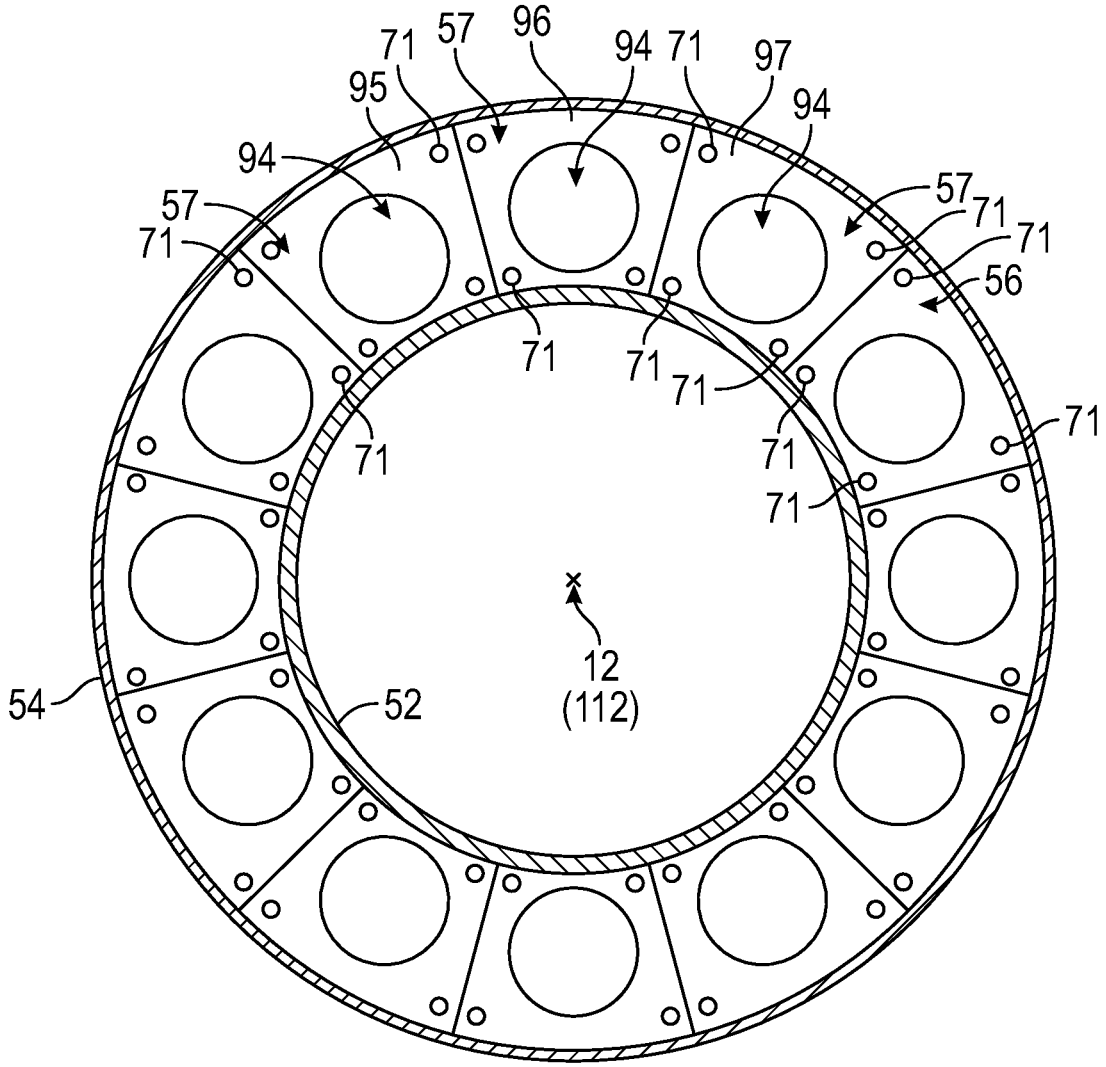
FIG. 3 depicts an aft forward-looking view of a dome-deflector assembly, taken at plane 3-3 of FIG. 1, according to an aspect of the present disclosure.

FIG. 3 depicts an aft forward-looking view of the dome 56, taken at plane 3-3 (FIG. 1) with other components removed from view, according to an aspect of the present disclosure. As shown in FIG. 3, the dome 56 extends circumferentially about the combustor axial centerline 112. The dome 56 may be comprised of a plurality of dome-deflector assemblies 57 that are connected together to define a continuous circumferential dome 56. For example, the dome 56 may include a first dome-deflector segment 95, a second dome-deflector segment 96, a third dome-deflector segment 97, etc., that define the circumferential dome 56. Each respective dome-deflector segment includes the dome-deflector assembly 57, which includes a dome-deflector swirler opening 94 therethrough, where the swirler assembly 58 (FIG. 2) extends through the dome-deflector swirler opening 94. As will be described below, each dome-deflector assembly 57 may include the dome portion 67 (FIG. 2) that is connected with the deflector portion 68 via a plurality of dome-deflector connecting members 71, such as a bolted connection.

Figure 4:
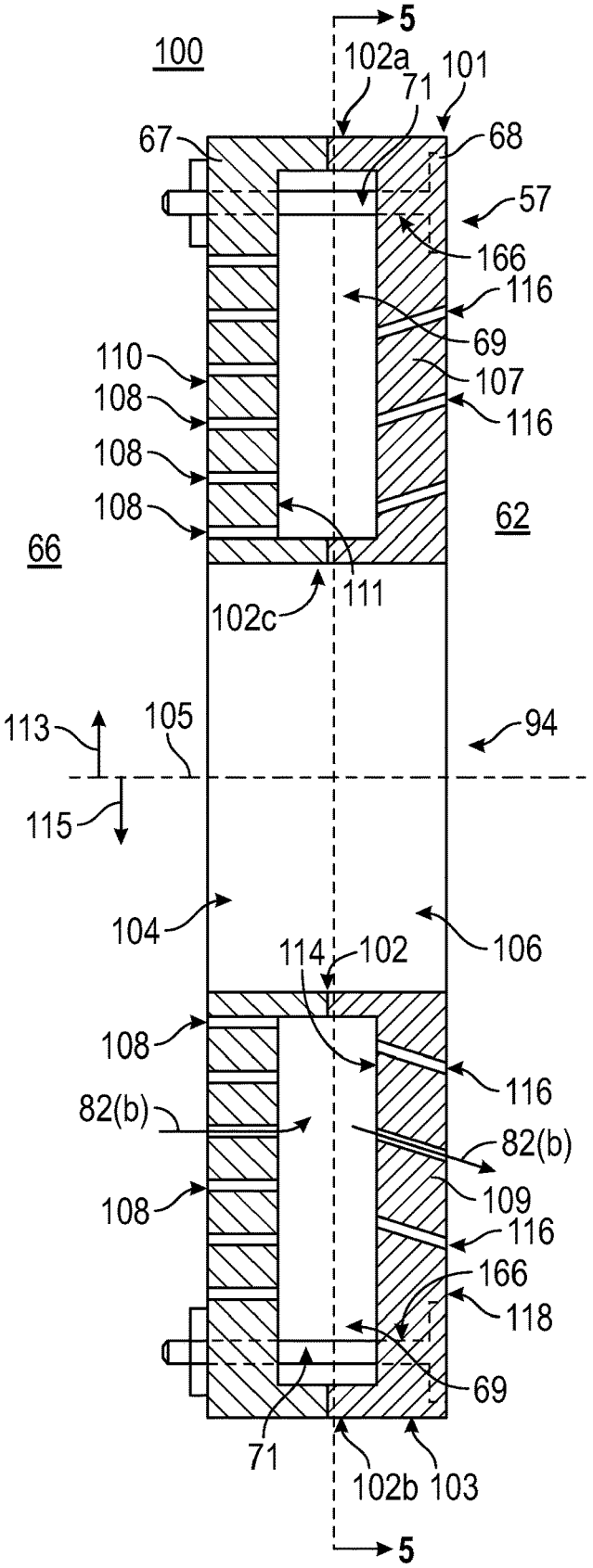
FIG. 4 depicts an enlarged cross-sectional view of a dome-deflector assembly, taken at detail view 100 of FIG. 2, according to an aspect of the present disclosure.
Figure 5:
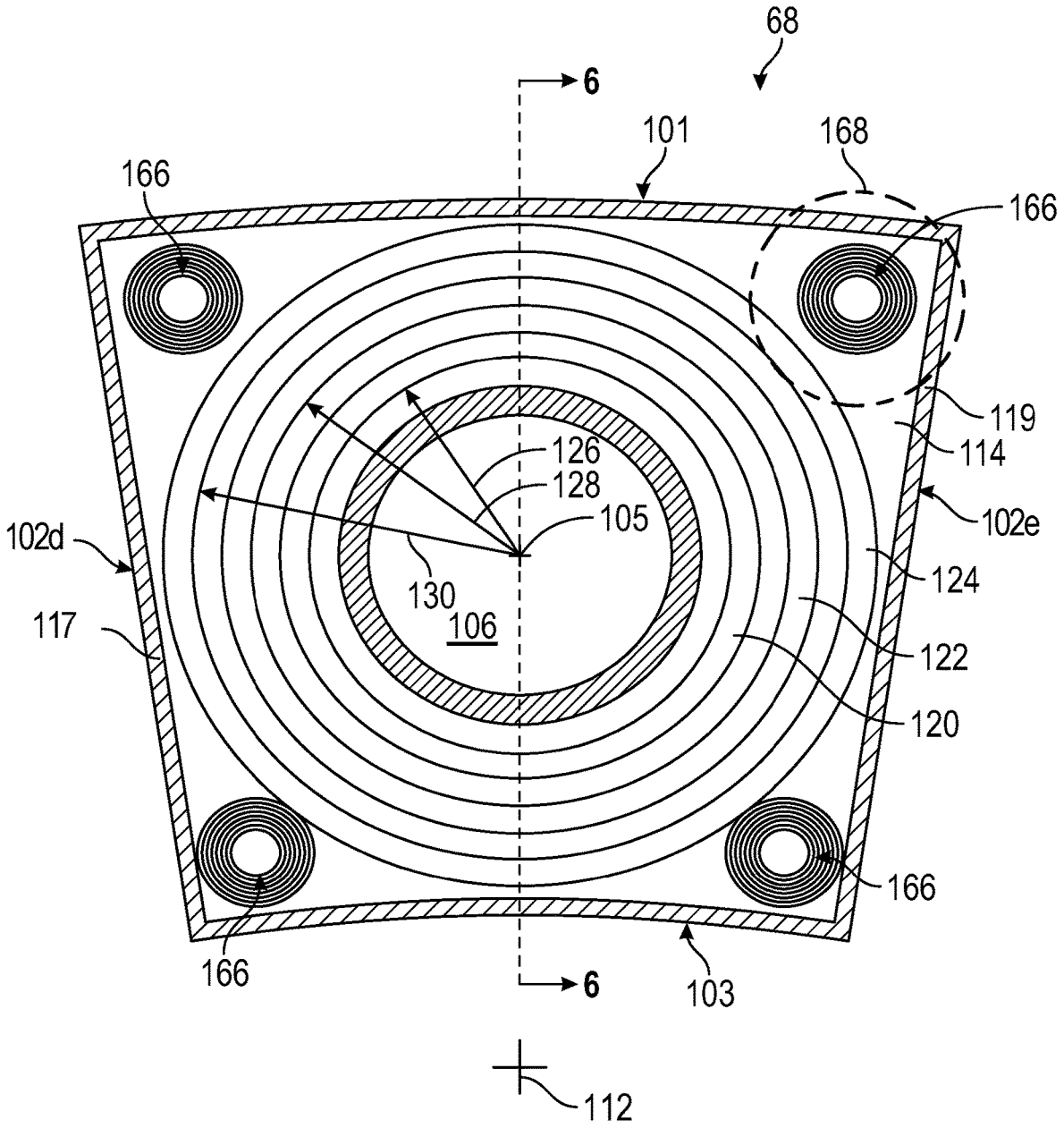
FIG. 5 is a cross-sectional view of the deflector portion, taken at plane 5-5 of FIG. 4, according to an aspect of the present disclosure.

FIG. 4 depicts an enlarged cross-sectional view of the dome-deflector assembly 57, taken at detail view 100 of FIG. 2, according to an aspect of the present disclosure. In FIG. 4, connections between the dome-deflector assembly 57 and the combustor liner 50 have been omitted, and the swirler assembly 58 has also been omitted. As shown in FIG. 4, the dome portion 67 includes a dome-side swirler opening 104 therethrough that defines a swirler opening centerline axis 105, and the deflector portion 68 includes a deflector-side swirler opening 106 therethrough that is also defined about the swirler opening centerline axis 105. The dome portion 67 and the deflector portion 68 are connected together at an outer connection interface 102*a* at a radially outer side 101 of the dome portion 67 and of the deflector portion 68, and are connected together at an inner connection interface 102*b* at a radially inner side 103 of the dome portion 67 and the deflector portion 68. The dome portion 67 and the deflector portion 68 are also connected together at a swirler opening interface 102*c* at the dome-side swirler opening 104 and the deflector-side swirler opening 106. Referring briefly to FIG. 5, the dome portion 67 and the deflector portion 68 are further connected at a first circumferential side interface 102*d* at a first side wall 117, and a second circumferential side interface 102*e* at a second side wall 119. Together, the dome-side swirler opening 104 and the deflector-side swirler opening 106 define the dome-deflector swirler opening 94 when the dome portion 67 and the deflector portion 68 are connected to form the dome-deflector assembly 57.

A dome-deflector cavity 69 is defined between the dome portion 67 and the deflector portion 68 within the outer connection interface 102*a*, the inner connection interface 102*b*, the first circumferential side interface 102*d*, the second circumferential side interface 102*e*, and the swirler opening interface 102*c*. The outer connection interface 102*a* at the radially outer side 101 and the inner connection interface 102*b* at the radially inner side 103 may form a tight seal of the dome-deflector cavity 69 at the radially outer side 101 and at the radially inner side 103 so as to define a sealed dome-deflector cavity 69 at the radially outer side 101 and at the radially inner side 103. Alternatively, the outer connection interface 102*a* at the radially outer side 101 and/or the inner connection interface 102*b* at the radially inner side 103 may include a plurality of circumferentially spaced airflow openings (not shown) therethrough so as to define an open (i.e., non-sealed) dome-deflector cavity 69. Regardless of whether the outer connection interface 102*a* and/or the inner connection interface 102*b* are sealed or non-sealed, the first circumferential side interface 102*d*, the second circumferential side interface 102*e*, and the swirler opening interface 102*c* may all be sealed interfaces.

The deflector portion 68 may be considered to include an outer deflector portion 107 on a first side 113 of the swirler opening centerline axis 105, and an inner deflector portion 109 on a second side 115 of the swirler opening centerline axis 105. The dome portion 67 includes a plurality of dome-side cooling airflow passages 108 that extend therethrough from a cold side 110 of the dome portion 67 to a cavity side 111 of the dome portion 67. The plurality of dome-side cooling airflow passages 108 provide a flow of the compressed air 82(*b*) from the pressure plenum 66 into the dome-deflector cavity 69. The compressed air 82(*b*) in the dome-deflector cavity 69 provides impingement cooling to a cold-side surface 114 of the deflector portion 68. As will be described in more detail below, the cold-side surface 114 of the deflector portion 68 may include various contours, such as grooves, arranged in patterns that provide additional cooling to the deflector portion 68 and provide stress-relief to the deflector portion 68 caused by the high temperatures of combustion against the hot-side surface 118 of the deflector portion 68. As used herein, the term "contour" or "contours" may refer to features such as grooves that are machined, forged, cast or otherwise manufactured in the surface of a structure, or raised elements such as ridges on the surface of a structure that are manufactured by, for example, additive manufacturing techniques. The deflector portion 68 may include a plurality of deflector cooling passages 116 that allow for a flow of the compressed air 82(*b*) from the dome-deflector cavity 69 to flow therethrough and to provide film cooling to a hot-side surface 118 of the deflector portion 68 adjacent to the combustion chamber 62.

FIG. 5 is a cross-sectional view of the deflector portion 68 taken at plane 5-5 of FIG. 4, according to an aspect of the present disclosure. In FIG. 5, the cold-side surface 114 of the deflector portion 68 includes a plurality of stress-relief grooves, which, in the FIG. 5 aspect, are circular grooves arranged about the swirler opening centerline axis 105. The plurality of circular grooves includes a first circular groove 120, a second circular groove 122, and a third circular groove 124, arranged in a concentric circular pattern about the deflector-side swirler opening 106. Thus, the circular first groove 120 has a first radius 126 with respect to the swirler opening centerline axis 105, the second circular groove has a second radius 128 greater than the first radius 126 with respect to the swirler opening centerline axis 105, and the third circular groove 124 has a third radius 130 greater than the second radius 128 with respect to the swirler opening centerline axis 105. Thus, each of the first circular groove 120, the second circular groove 122, and the third circular groove 124 extends about the deflector-side swirler opening 106 and are arranged concentric to one another with respect to the swirler opening centerline axis 105 through the deflector-side swirler opening 106.

Figure 6:
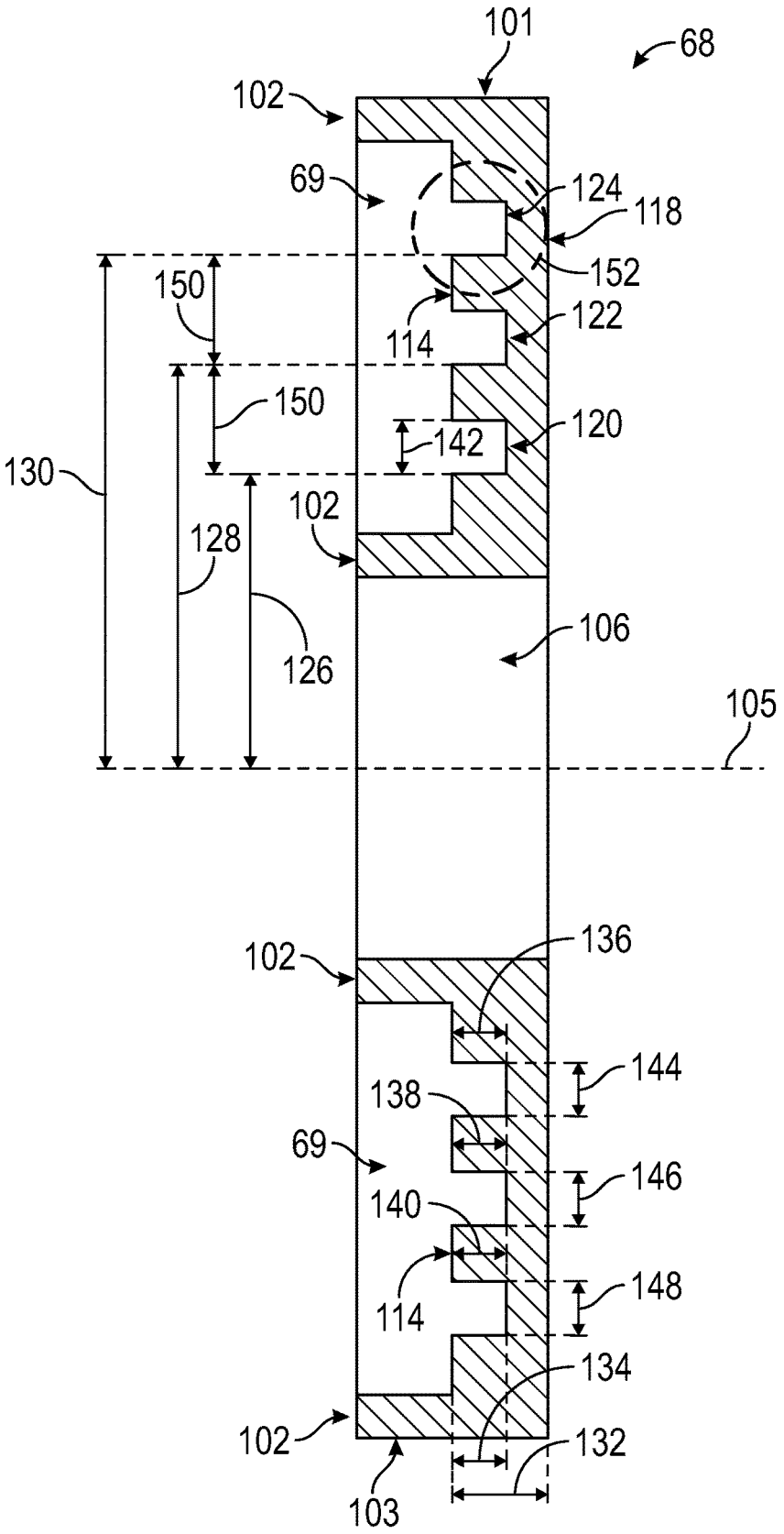
FIG. 6 is a cross-sectional view of the dome portion, taken at plane 6-6 of FIG. 5, according to an aspect of the present disclosure.

FIG. 6 is a cross-sectional view of the deflector portion 68, taken at plane 6-6 of FIG. 5, according to an aspect of the present disclosure. As shown in FIG. 6, the deflector portion 68 may have a thickness (t) 132 from the cold-side surface 114 to the hot-side surface 118. Each of the plurality of circular grooves may have a depth (d) 134 from the cold-side surface 114, and a ratio of the thickness (t) 132 to the depth (d) 134 may satisfy a relationship of $t/d<2$. Of course, the depth (d) 134 of each of the plurality of stress-relief grooves need not be same, and different depths could be implemented for each respective groove or across differing deflector portions 68 of the dome-deflector assembly 57. For example, the first circular groove 120 may be arranged a first depth 136, the second circular groove 122 may be arranged at a second depth 138 that is the same as, or that is different from, the first depth 136, and the third circular groove 124 may be arranged at a third depth 140 that is the same, or that is different from, either or both of the first depth 136 and the second depth 138. In addition, each of the plurality of circular grooves may be arranged to have a groove width (w) 142. Similar to the groove depth (d) 134, each of the plurality of circular grooves may be arranged to have a different groove width 142. For example, the first circular groove 120 may be arranged to have a first groove width 144, the second circular groove 122 may be arranged to have a second groove width 146 that may be the same as, or different from, the first groove width 144, and the third circular groove 124 may be arranged to have a third groove width 148 that is the same as, or that is different from, either or both of the first groove width 144 and the second groove width 146. The circular grooves may also have a radial spacing 150 between the grooves, and a ratio of the first radius 126 to the radial spacing 150 may be less than two (e.g., 126/150<2.0).

FIG. 7A is an enlarged cross-sectional view of the third circular groove 124 taken at detail view 152 of FIG. 6, according to an aspect of the present disclosure. In FIG. 7A, the third circular groove 124 is shown to have a generally rectangular profile with a generally flat bottom 154. While FIG. 7A depicts the third circular groove 124, a similar arrangement as that shown in FIG. 7A may also be applicable to the first circular groove 120 and/or to the second circular groove 122.

FIG. 7B depicts a cross-sectional view of an alternate arrangement of the third circular groove 124 to that shown in FIG. 7A. In FIG. 7B, rather than a generally rectangular-shaped profile with the flat groove bottom 154, the third circular groove 124 may instead have a profile with a rounded bottom 156. The rounded bottom 156 may have a radius 158, which may correspond to the third groove width 148.

FIG. 7C depicts a cross-sectional view of another alternate arrangement of the third circular groove 124 to that shown in FIG. 7A. In FIG. 7C, rather than the rounded bottom 156 having the radius 158 corresponding to the third groove width 148, the third circular groove 124 may include a combination of the FIG. 7A flat groove bottom 154 and rounded corners 160 to define a squoval profile having a squoval bottom 156*a*. Alternatively, the rounded corners 160 may be chamfered corners instead of rounded corners. Similar to the FIG. 7A aspect, similar arrangements as those shown in FIG. 7B and FIG. 7C for the third circular groove 124 may also be implemented for the first circular groove 120 and/or for the second circular groove 122.

FIG. 7D depicts a cross-sectional view of another alternate arrangement of the third circular groove 124 to that shown in FIG. 7A. In FIG. 7D, a V-shaped profile 162 is illustrated. The V-shaped profile 162 may have a groove angle 164, which may have a range from two degrees to fifteen degrees in one aspect. In another aspect, the groove angle 164 may have a range from fifteen degrees to forty five degrees. Of course, other ranges of the groove angle 164 may be implemented instead and the groove angle 164 is not limited to the foregoing ranges.

Returning to FIG. 5, the deflector portion 68 includes a plurality of connector openings 166 therethrough. Referring to FIG. 3 and FIG. 4, the dome-deflector connecting members 71 may extend through the connector openings 166 so as to connect the deflector portion 68 with the dome portion 67.

Figure 8:
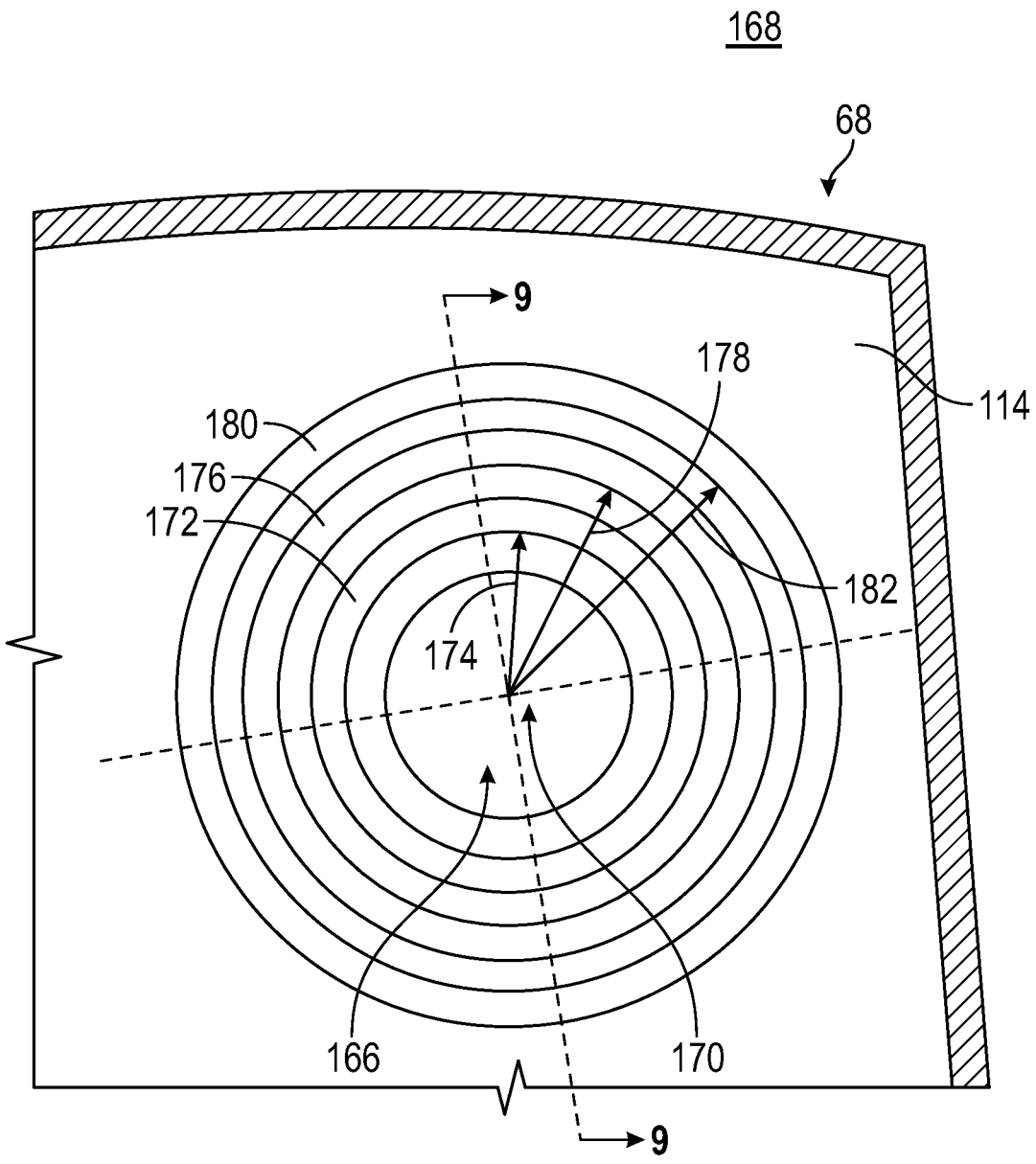
FIG. 8 is an enlarged partial cross-sectional view of the connector opening, taken at detail view 168 of FIG. 5, according to an aspect of the present disclosure.

FIG. 8 is an enlarged partial cross-sectional view of the connector opening 166, taken at detail view 168 of FIG. 5, according to an aspect of the present disclosure. The connector opening 166 may define a centerline axis 170 therethrough. The connector opening 166 may have a plurality of stress-relief grooves arranged in a pattern (e.g., by way of non-limiting example in a concentric circular pattern) on the cold-side surface 114 about the connector opening 166. For example, similar to the plurality of stress-relief grooves in FIG. 5 arranged about the deflector-side swirler opening 106, a first stress-relief groove 172 may be arranged about the connector opening 166 at a first radius 174, a second stress-relief groove 176 may be arranged at a second radius 178 about the connector opening 166, and a third stress-relief groove 180 may be arranged at a third radius 182 about the connector opening 166. Thus, each of the first stress-relief groove 172, the second stress-relief groove 176, and the third stress-relief groove 180 is concentric circular grooves that extend about the connector opening 166.

Figure 9:
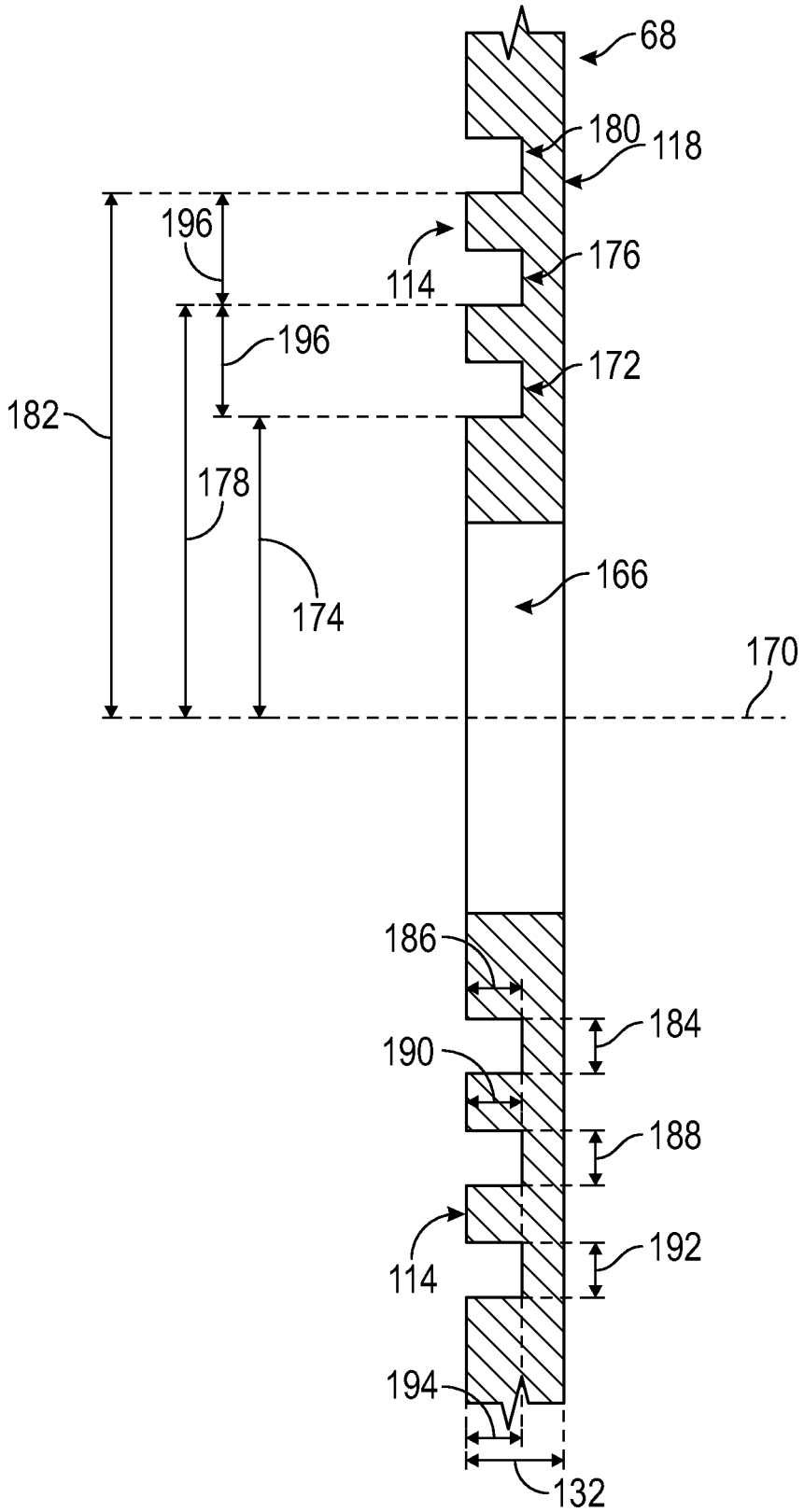
FIG. 9 is a partial cross-sectional view of the connector opening, taken at plane 9-9 of FIG. 8, according to an aspect of the present disclosure.

FIG. 9 is a partial cross-sectional view of the connector opening 166, taken at plane 9-9 of FIG. 8, according to an aspect of the present disclosure. Similar to plurality of stress-relief grooves shown in FIG. 6, in FIG. 9, the first stress-relief groove 172 may have a first width 184 and a first depth 186, the second stress-relief groove 176 may have a second width 188 and a second depth 190, and the third stress-relief groove 180 may have a third width 192 and a third depth 194. The first depth 186, the second depth 190, and the third depth 194 may be the same depth, or may be different from one another. In addition, the first width 184, the second width 188, and the third width 192 may be the same width, or may be different from one another. Additionally, the first stress-relief groove 172 and the second stress-relief groove 176 may be arranged at a groove spacing 196, and the second stress-relief groove 176 and the third stress-relief groove 180 may also be arranged at the groove spacing 196. While FIG. 8 and FIG. 9 depict an example of one of the connector openings 166, and the plurality of stress-relief grooves about the one connector opening 166, a similar arrangement may be implemented at each of the connector openings 166 of the deflector portion 68, or may be implemented in some but not necessarily all of the connector openings 166 of the deflector portion 68. The concentric circular stress-relief grooves being arranged about the connector opening 166 provide heat related stress-relief to the connector opening 166 and the surrounding material.

Figure 10:
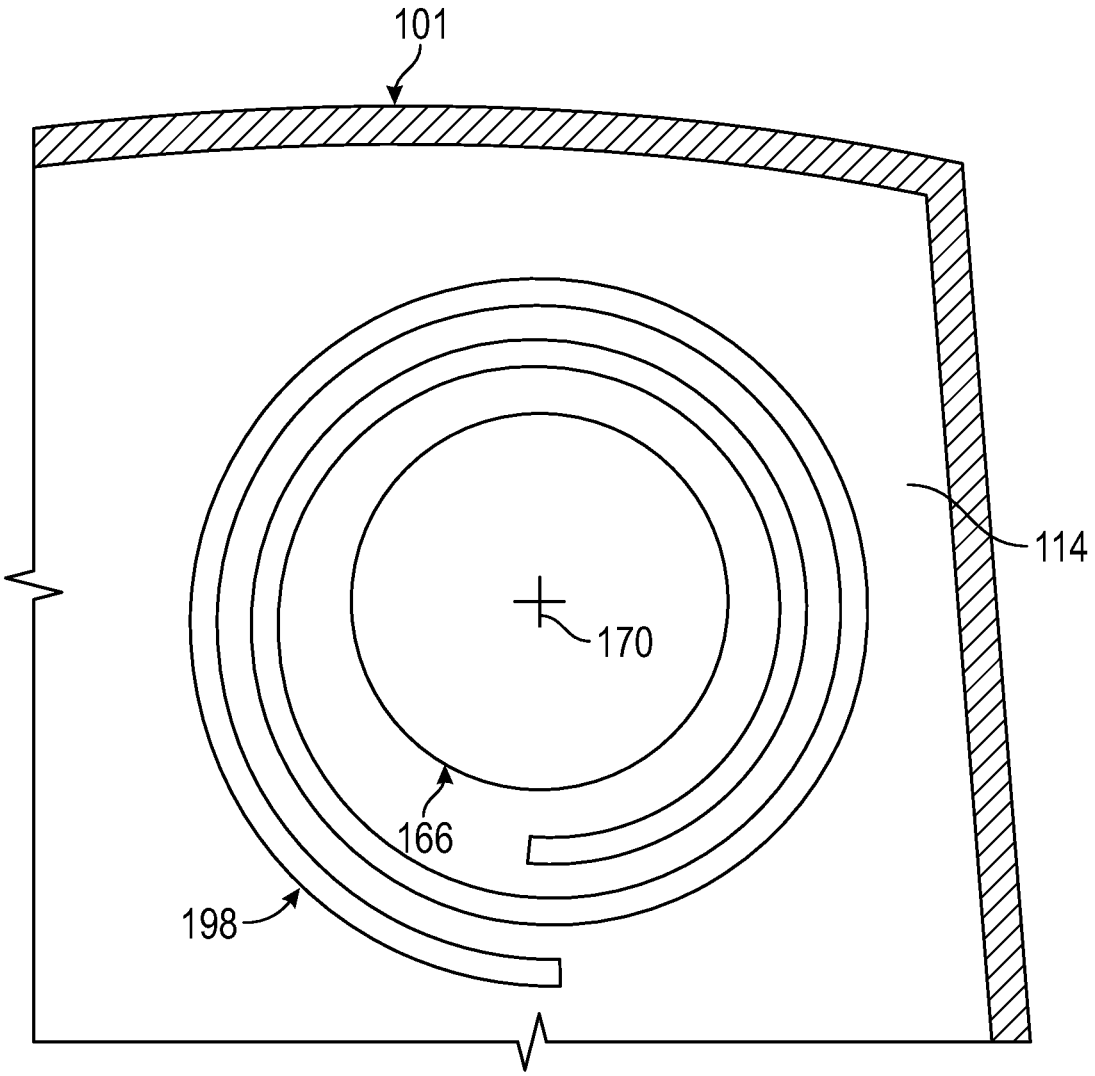
FIG. 10 depicts a partial cross-sectional view of an alternate arrangement of a stress-relief groove about the connector opening to that shown in FIG. 8, according to an aspect of the present disclosure.

FIG. 10 depicts a partial cross-sectional view of an alternate arrangement of a stress-relief groove about the connector opening 166 to that shown in FIG. 8. In FIG. 10, a spiral stress-relief groove 198 is provided about the connector opening 166. The spiral stress-relief groove 198 in FIG. 10 is shown with two revolutions about the connector opening 166, but more than two revolutions or fewer than two revolutions may be implemented in the spiral stress-relief groove 198 instead. The spiral stress-relief groove 198 provides some additional cooling around the connector opening 166 so as to provide heat related stress-relief to the connector opening 166 that may occur due to the high combustion temperatures on the hot-side surface 118 (not shown in FIG. 10) of the deflector portion 68.

Figure 11:
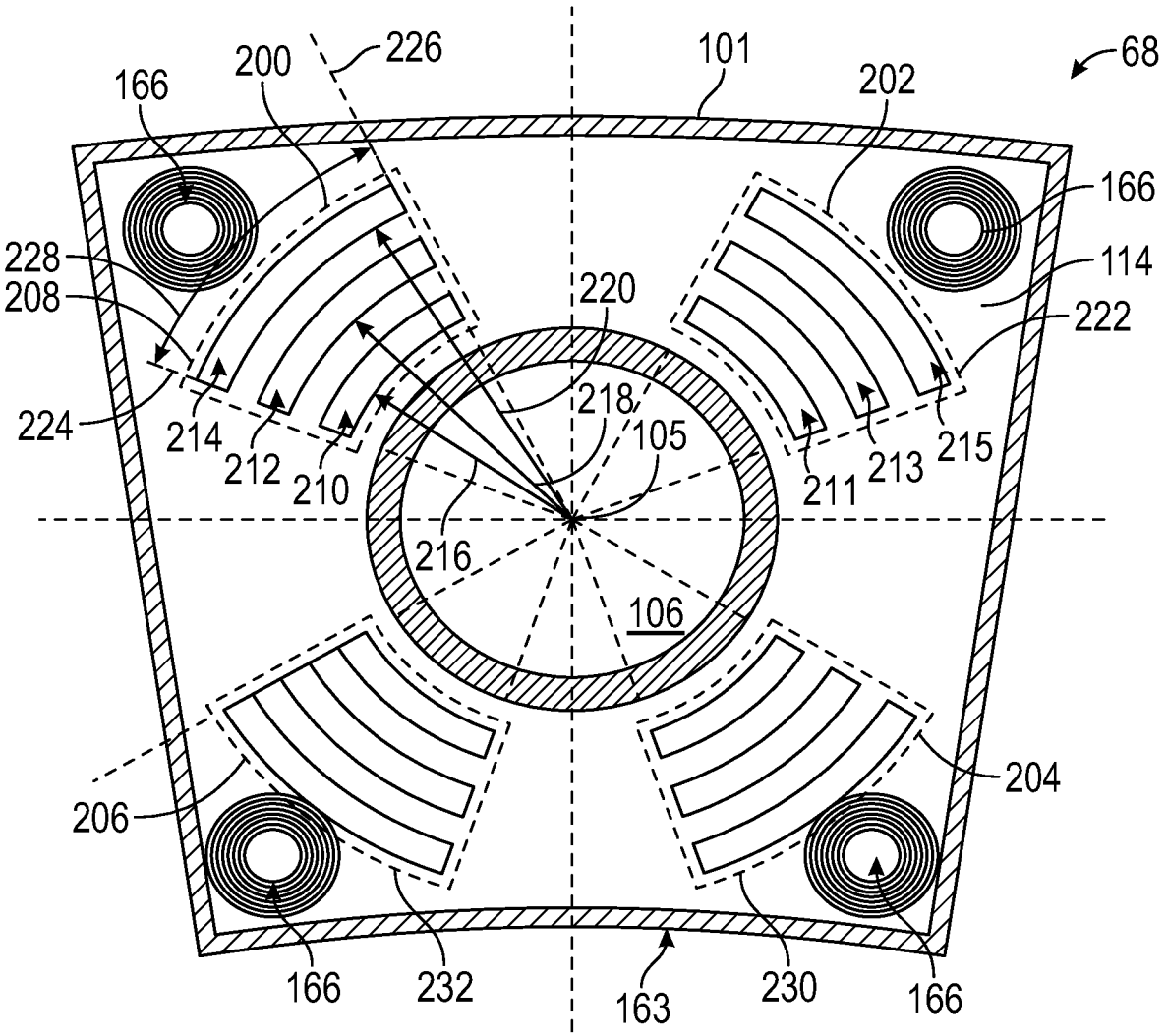
FIG. 11 depicts a cross-sectional view of an alternate deflector portion to that shown in FIG. 5, according to another aspect of the present disclosure.

FIG. 11 depicts a cross-sectional view of an alternate deflector portion 68 to that shown in FIG. 5, according to another aspect of the present disclosure. The deflector portion 68 of FIG. 11 is similar to that of FIG. 5 and, therefore, like elements have the same reference numerals. In the FIG. 11 aspect, rather than the plurality of stress-relief grooves in the cold-side surface 114 being arranged in the concentric circular pattern as shown in FIG. 5, the plurality of stress-relief grooves are arranged within a plurality of stress-relief zones of the deflector portion 68, including a first stress-relief zone 200, a second stress-relief zone 202, a third stress-relief zone 204, and a fourth stress-relief zone 206. Each of the first stress-relief zone 200, the second stress-relief zone 202, the third stress-relief zone 204, and the fourth stress-relief zone 206 is arranged between the deflector-side swirler opening 106 and a respective one of the connector openings 166. The plurality of stress-relief grooves in the cold-side surface 114 of FIG. 11 includes a first plurality of stress-relief grooves arranged in a first group 208 of stress-relief grooves in the first stress-relief zone 200 among the plurality of stress-relief zones, and a second plurality of stress-relief grooves arranged in a second group 222 of stress-relief grooves in the second stress-relief zone 202 among the plurality of stress-relief zones. The first group 208 of stress-relief grooves may include a first stress-relief groove 210, a second stress-relief groove 212, and a third stress-relief groove 214. The second group 222 of stress-relief grooves may include a fourth stress-relief groove 211, a fifth stress-relief groove 213, and a sixth stress-relief groove 215. Each of the first stress-relief groove 210, the second stress-relief groove 212, the third stress-relief groove 214, the fourth stress-relief groove 211, the fifth stress-relief groove 213, and the sixth stress-relief groove 215 may be arc shaped grooves. For example, the first stress-relief groove 210 may be an arc shaped groove having a first radius 216 with respect to the swirler opening centerline axis 105, the second stress-relief groove 212 may be an arc shaped groove having a second radius 218 that is greater than the first radius 216, and the third stress-relief groove 214 may be an arc shaped groove having a third radius 220 that is greater than the second radius 218. Each of the first stress-relief groove 210, the second stress-relief groove 212, and the third stress-relief groove 214 may extend in the circumferential direction about the swirler opening centerline axis 105 between a first boundary line 224 and a second boundary line 226, where an angle 228 between the first boundary line 224 and the second boundary line 226 may be in a range from fifteen degrees to sixty degrees. Of course, the angle 228 may be smaller than fifteen degrees or may be greater than forty-five degrees and the range of the angle 228 is not limited to the foregoing. The plurality of stress-relief grooves in the second group 222 may be similar to the plurality of stress-relief grooves in the first group 208 (i.e., the first stress-relief groove 210, the second stress-relief groove 212, and the third stress-relief groove 214). Similarly, a third group 230 of the plurality of stress-relief grooves may be implemented in the third stress-relief zone 204, and a fourth group 232 of the plurality of stress-relief grooves may be implemented in the fourth stress-relief zone 206. The plurality of stress-relief grooves in the third group 230 and the plurality of stress-relief grooves in the fourth group 232 may also be similar to the plurality of stress-relief grooves in the first group 208.

Figure 12:
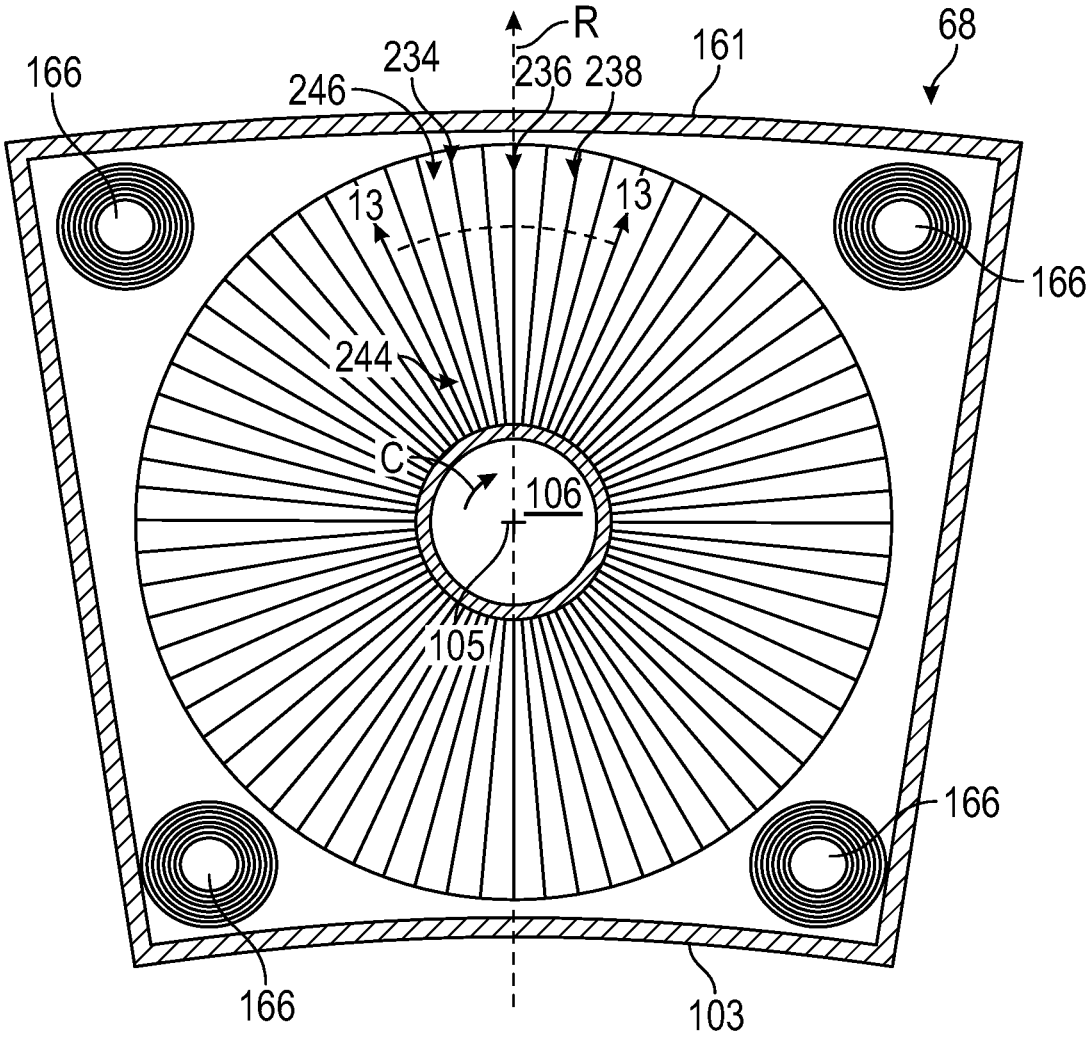
FIG. 12 depicts a cross-sectional view of an alternate deflector portion to that shown in FIG. 5, according to another aspect of the present disclosure.

FIG. 12 depicts a cross-sectional view of another alternate deflector portion 68 to that shown in FIG. 5, according to another aspect of the present disclosure. In FIG. 12, the deflector-side swirler opening defines the circumferential direction (C) about the swirler opening centerline axis 105, and a radial direction (R) extends outward from the swirler opening centerline axis 105. A plurality of V-shaped grooves, including a first V-shaped groove 234, a second V-shaped groove 236, and a third V-shaped groove 238 extend generally radially outward in the radial direction with respect to the deflector-side swirler opening 106.

Figure 13:
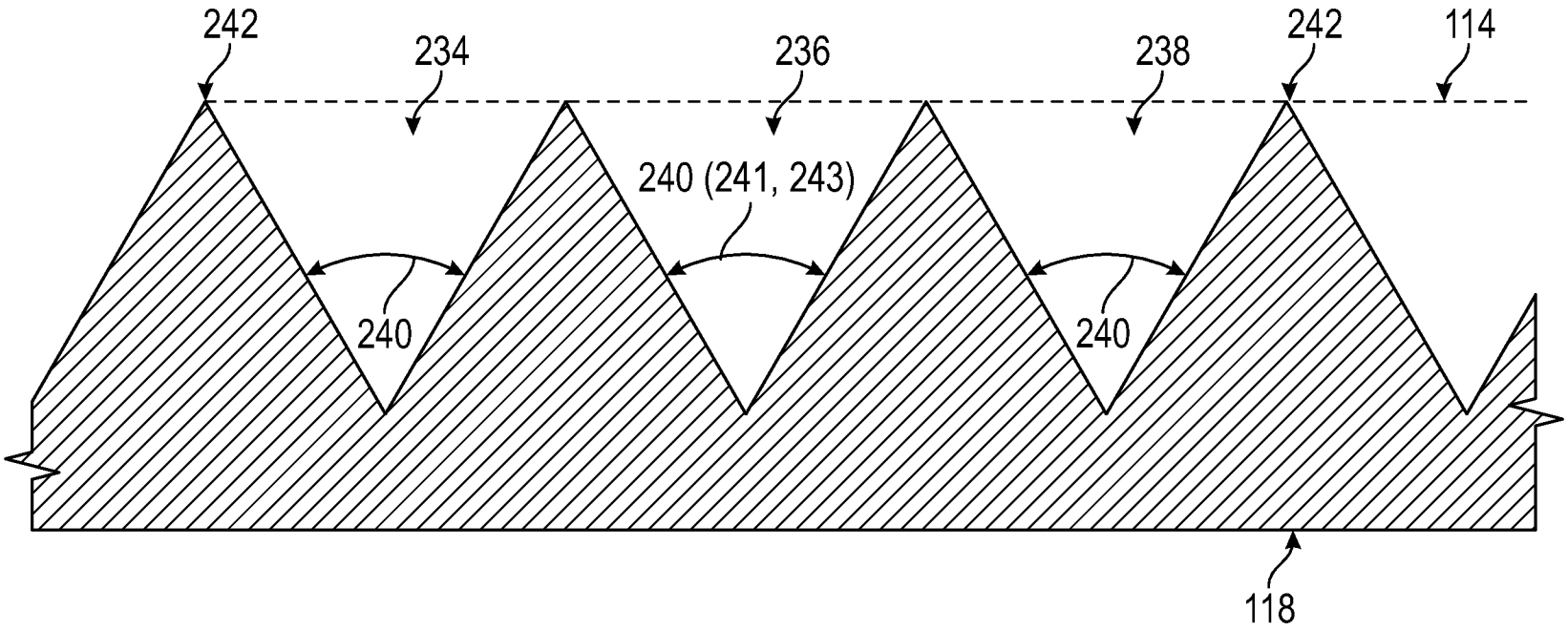
FIG. 13 is a partial cross-sectional view of V-shaped grooves, taken at circumferential cut-plane 13-13 of FIG. 12, according to an aspect of the present disclosure.

FIG. 13 is a partial cross-sectional view of the V-shaped grooves, taken at circumferential cut-plane 13-13 of FIG. 12. In FIG. 13, the V-shaped grooves may have a groove angle 240. For reference purposes, shown in FIG. 13 with a dashed line is the cold-side surface 114 of the deflector portion 68, which may correspond to an apex 242 between each of the V-shaped grooves. The groove angle 240 may vary along a radial length of each V-shaped groove. For example, at a radially inner end 244 (FIG. 12) of the first V-shaped groove 234, the groove angle 240 may be a first angle 241 (e.g., two degrees) and the groove angle 240 may increase along the radial length of the first V-shaped groove 234 between the radially inner end 244 to a radially outer end 246 of the first V-shaped groove 234 to a second groove angle 243 (e.g., fifteen degrees). That is, the groove angle 240 may be two degrees (first groove angle 241) at the radially inner end 244 of the first V-shaped groove 234 and may gradually increase along the radial length of the first V-shaped groove 234 to be fifteen degrees (second groove angle 243) at the radially outer end 246 of the first V-shaped groove 234.

Figure 14:
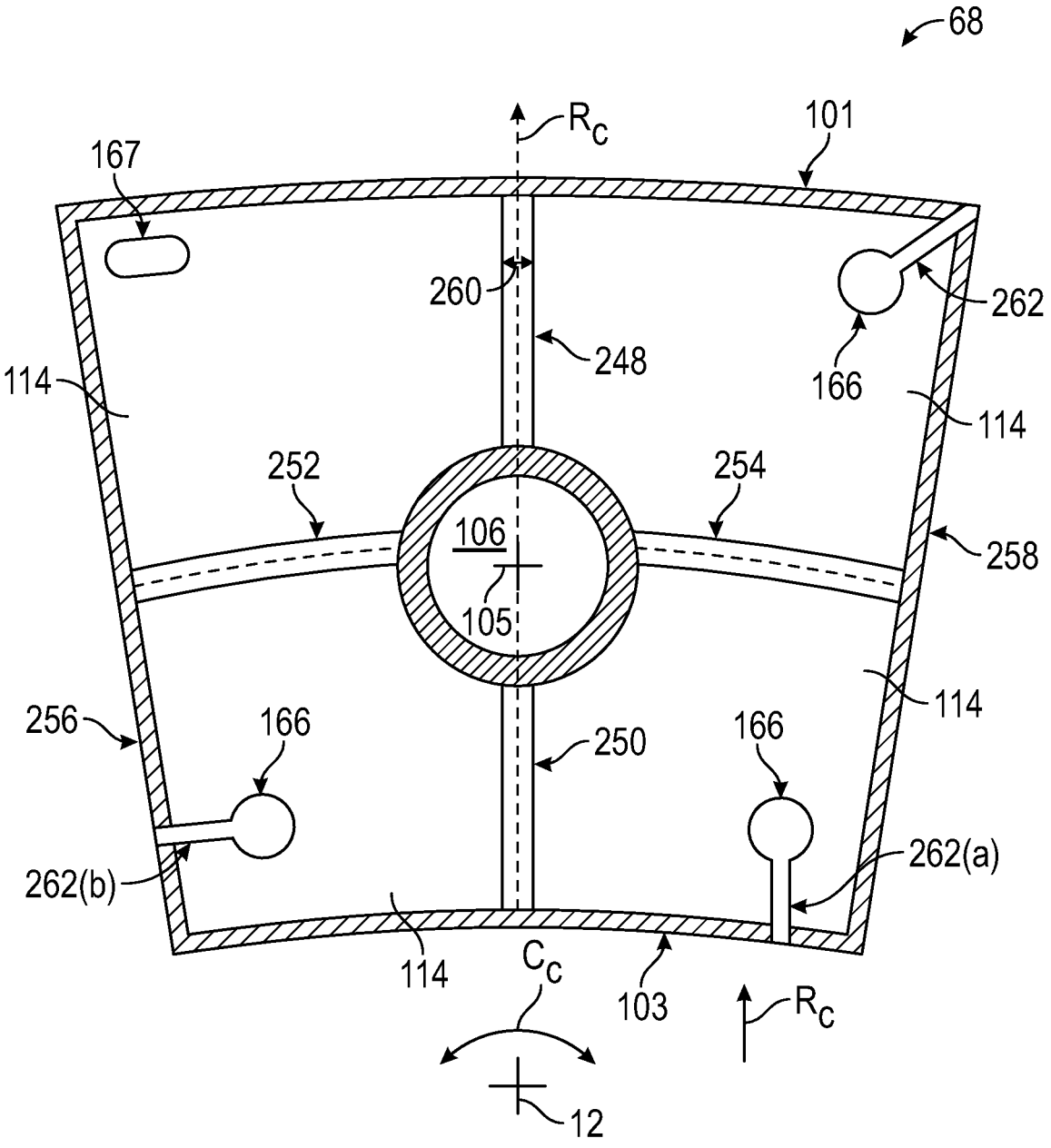
FIG. 14 depicts a cross-sectional view of another alternate deflector portion to that shown in FIG. 5, according to another aspect of the present disclosure.

FIG. 14 depicts a cross-sectional view of another alternate deflector portion 68 to that shown in FIG. 5, according to another aspect of the present disclosure. In the FIG. 14 aspect, a plurality of stress-relief grooves, including a first groove 248, a second groove 250, a third groove 252, and a fourth groove 254 are included in the cold-side surface 114. The first groove 248 may extend radially outward from the deflector-side swirler opening 106 to the radially outer side 101 of the deflector portion 68, and the second groove 250 may extend radially from the deflector-side swirler opening 106 to the radially inner side 103 of the deflector portion 68. The third groove 252 may extend in the combustor circumferential direction (Cc) from the deflector-side swirler opening 106 to a first side 256 of the deflector portion 68, and the fourth groove 254 may extend in the combustor circumferential direction (Cc) from the deflector-side swirler opening 106 to a second side 258 of the deflector portion 68. The first groove 248 may have a groove width 260 and may have a depth and a shape similar to any of the aspects depicted in FIGS. 7A to 7C. The second groove 250, the third groove 252, and the fourth groove 254 may have a similar width, depth, and shape as the first groove 248. Alternatively, they may vary and need not be the same. In the FIG. 14 aspect, the connector openings 166 are included in the deflector portion 68. The connector openings 166 may be circular openings, or may be a slotted connector opening 167 instead. The slotted connector opening 167 may provide for better flexibility due to expansion and contraction of the deflector portion 68 caused by exposure to the high heat of combustion. In addition, to provide additional stress-relief at the connector openings 166, each of the connector openings 166 may include a slotted portion 262 extending radially and circumferentially from the connector opening 166 through the deflector portion 68. Alternatively, a slotted portion 262(*a*) that extends in the combustor radial direction ($R_C$) may be implemented, or a slotted portion 262(*b*) that may extend in the combustor circumferential direction ($C_C$) may be implemented.

Figure 15:
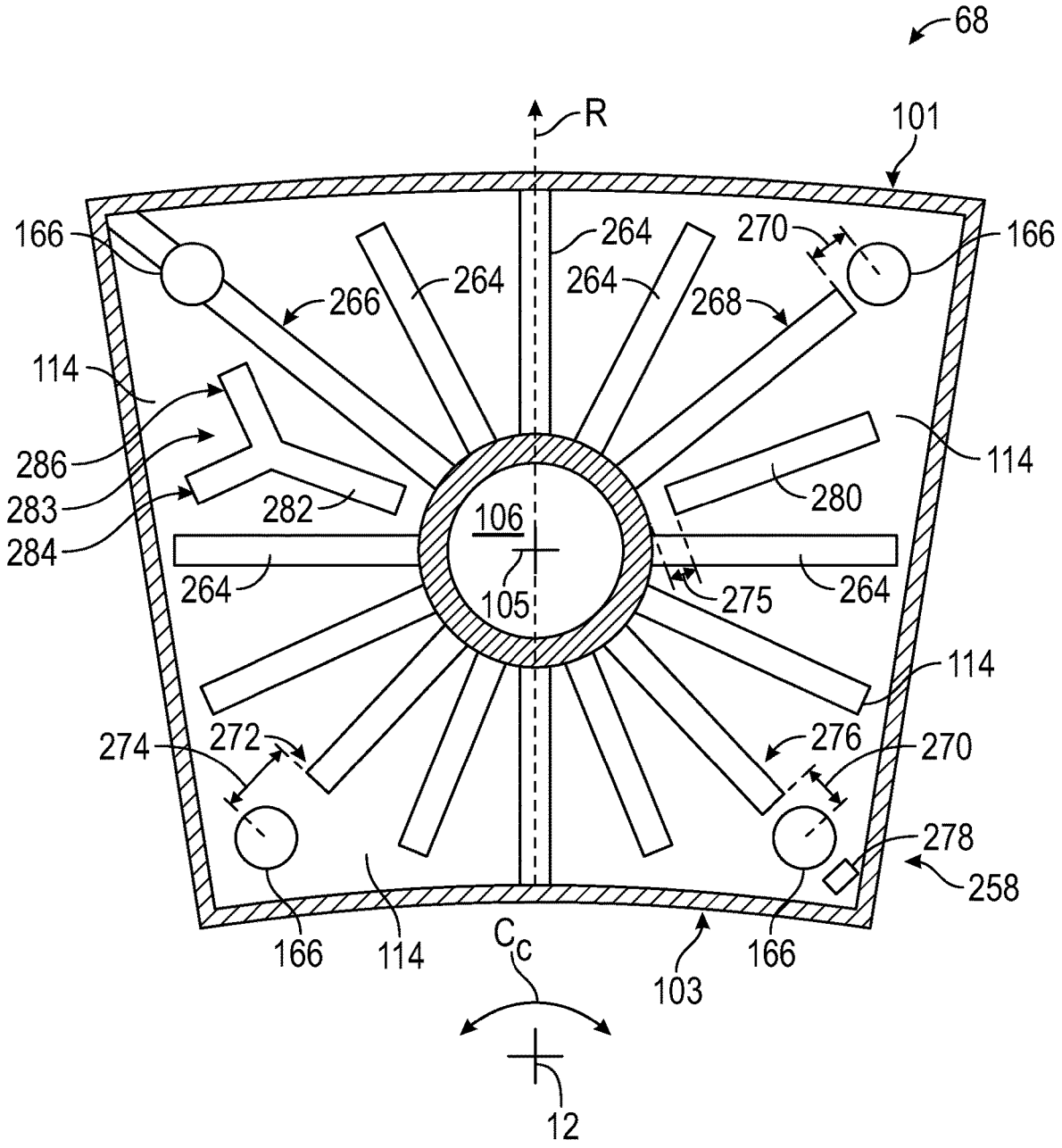
FIG. 15 depicts a cross-sectional view of yet another alternate deflector portion to that shown in FIG. 5, according to another aspect of the present disclosure.

FIG. 15 depicts a cross-sectional view of yet another alternate deflector portion 68 to that shown in FIG. 5, according to another aspect of the present disclosure. In the FIG. 15 aspect, the deflector portion 68 includes a plurality of grooves 264 extending outwardly from the deflector-side swirler opening 106. Each of the grooves 264 may be similar to, for example, the first groove 248 of the FIG. 14 aspect.

In FIG. 15, however, various arrangements of the grooves with respect to the connector openings 166 are shown. In one aspect, a first groove 266 may extend from the deflector-side swirler opening 106 and extend through the connector opening 166. In another aspect, a second groove 268 may extend from the deflector-side swirler opening 106 and may terminate a first distance 270 from the connector opening 166, where the first distance 270 may be a relatively short distance such that the second groove 268 terminates close to the connector opening 166. In yet another aspect, a third groove 272 may extend radially from the deflector-side swirler opening 106 and may terminate a second distance 274 from the connector opening, where the second distance 274 may be greater than the first distance 270 such that a larger gap is present between the third groove 272 and the connector opening 166. In still another aspect, a fourth groove 276 may extend radially from the deflector-side swirler opening 106 and terminate the first distance 270 from the connector opening 166, but an outer groove extension 278 may be provided between the connector opening 166 and the second side 258 of the deflector portion 68. In still yet another aspect, a fifth groove 280 may commence an offset distance 275 from the deflector-side swirler opening 106 rather than extending to the deflector-side swirler opening 106. In another aspect, a sixth groove 282 may include a branched portion 283 that includes a first branch 284 and a second branch 286 that may form a generally Y-shaped branch for the branched portion 283. Of course, more than two branches could be implemented with the branched portion 283. Further still any of the previously discussed grooves could be branched. Thus, each of the foregoing aspects provides heat related stress-relief at the connector openings 166.

Each of the foregoing aspects provide a dome-deflector assembly that can provide heat related stress-relief to the connector openings of the deflector portion. The grooves included in the cold-side surface of the deflector portion also allow for additional impingement cooling to the deflector portion, thereby providing additional heat related stress-relief to the deflector portion. Moreover, while the foregoing aspects are described in relation to specific embodiments, any one or more of the foregoing aspects may be implemented in conjunction with any one or more other aspects described above so as to mix and match the aspects as may be desired to provide a desired cooling effect to the deflector portion.

While the foregoing description relates generally to a gas turbine engine, the gas turbine engine may be implemented in various environments. For example, the engine may be implemented in an aircraft, but may also be implemented in non-aircraft applications, such as power generating stations, marine applications, or oil and gas production applications. Thus, the present disclosure is not limited to use in aircraft.

Further aspects of the present disclosure are provided by the subject matter of the following clauses.

A dome-deflector assembly for a combustor of a gas turbine, the dome-deflector assembly including a dome portion having a dome-side swirler opening therethrough, and a deflector portion having a deflector-side swirler opening therethrough, the dome portion and the deflector portion being connected together to form a dome-deflector cavity therebetween, wherein the deflector portion includes a first-side surface and a second-side surface, the second-side surface being arranged within the dome-deflector cavity, and the second-side surface including a plurality of stress-relief contours arranged in a pattern about the deflector-side swirler opening.

The dome-deflector assembly according to the preceding clause, wherein the deflector portion includes a plurality of connector openings therethrough.

The dome-deflector assembly according to any preceding clause, wherein at least one of the plurality of connector openings includes a slotted portion extending outward from the at least one of the plurality of connector openings and extending through the deflector portion.

The dome-deflector assembly according to any preceding clause, wherein the plurality of stress-relief contours comprises a plurality of circumferential grooves extending about the deflector-side swirler opening.

The dome-deflector assembly according to any preceding clause, wherein the plurality of circumferential grooves are arranged concentric to one another with respect to a centerline axis through the deflector-side swirler opening.

The dome-deflector assembly according to any preceding clause, wherein the plurality of circumferential grooves includes a first circumferential groove having a first radius with respect to the centerline axis, a second circumferential groove having a second radius greater than the first radius with respect to the centerline axis, and a third circumferential groove having a third radius greater than the second radius with respect to the centerline axis.

The dome-deflector assembly according to any preceding clause, wherein the deflector portion has a thickness (t), and each of the plurality of circumferential grooves has a depth (d) from the cold-side surface, and a ratio $t/d<2$.

The dome-deflector assembly according to any preceding clause, wherein at least one of the plurality of connector openings includes at least one connector opening stress-relief groove in the second-side surface about the at least one of the plurality of connector openings.

The dome-deflector assembly according to any preceding clause, wherein the at least one connector opening stress-relief groove comprises a spiral groove extending about the at least one of the plurality of connector openings.

The dome-deflector assembly according to any preceding clause, wherein the at least one connector opening stress-relief groove includes a plurality of concentric circular grooves extending about the at least one of the plurality of connector openings.

The dome-deflector assembly according to any preceding clause, wherein the deflector-side swirler opening defines a centerline axis therethrough, and a radial direction extending outward from the centerline axis, the plurality of stress-relief contours extending outward with respect to the deflector-side swirler opening.

The dome-deflector assembly according to any preceding clause, wherein each stress-relief contour of the plurality of stress-relief contours is a V-shaped groove.

The dome-deflector assembly according to any preceding clause, wherein each V-shaped groove has a groove angle that widens away from the deflector-side swirler opening.

The dome-deflector assembly according to any preceding clause, wherein the groove angle increases from a first groove angle at a radially inner end of the V-shaped groove to a second groove angle greater than the first groove angle at a radially outer end of the V-shaped groove.

The dome-deflector assembly according to any preceding clause, wherein the groove angle has a range from two degrees as the first groove angle to fifteen degrees as the second groove angle.

The dome-deflector assembly according to any preceding clause, wherein the deflector-side swirler opening defines a centerline axis therethrough, a radial direction extending from the centerline axis, and a circumferential direction extending about the centerline axis, the deflector portion defines a plurality of stress-relief zones, respective ones of the stress-relief zones being arranged between the deflector-side swirler opening and a respective one of the plurality of connector openings.

The dome-deflector assembly according to any preceding clause, wherein the plurality of stress-relief contours comprise a plurality of stress-relief grooves including a first plurality of stress-relief grooves arranged in a first group in a first stress-relief zone among the plurality of stress-relief zones, and a second plurality of stress-relief grooves arranged in a second group in a second stress-relief zone among the plurality of stress-relief zones.

The dome-deflector assembly according to any preceding clause, wherein the first group of stress-relief grooves includes a first stress-relief groove having a first radius extending in the circumferential direction with respect to the centerline axis, a second stress-relief groove having a second radius greater than the first radius and extending in the circumferential direction with respect to the centerline axis, and a third stress-relief groove having a third radius greater than the second radius and extending in the circumferential direction with respect to the centerline axis.

The dome-deflector assembly according to any preceding clause, wherein the first group of stress-relief grooves extend circumferentially between a range from fifteen degrees to sixty degrees about the centerline axis.

The dome-deflector assembly according to any preceding clause, wherein the deflector portion includes four connecting openings, and the plurality of stress-relief zones includes four stress-relief zones.

Although the foregoing description is directed to some exemplary embodiments of the present disclosure, other variations and modifications will be apparent to those skilled in the art, and may be made without departing from the spirit or the scope of the disclosure. Moreover, features described in connection with one embodiment of the present disclosure may be used in conjunction with other embodiments, even if not explicitly stated above.

We claim:

1. A dome-deflector assembly for a combustor of a gas turbine, the dome-deflector assembly comprising:

a dome portion having a dome-side swirler opening therethrough; and a deflector portion having a deflector-side swirler opening therethrough and extending about a deflector-side swirler opening centerline axis, the dome portion and the deflector portion being connected together to form a dome-deflector cavity therebetween, wherein the deflector portion extends from a first-side surface to a second-side surface, the second-side surface being arranged within the dome-deflector cavity, and a plurality of stress-relief contours extending within the second-side surface forming a plurality of circumferential grooves extending circumferentially about the deflector-side swirler opening centerline axis and arranged in a pattern about the deflector-side swirler opening.

2. The dome-deflector assembly according to claim 1, wherein the deflector portion includes a plurality of connector openings therethrough.

3. The dome-deflector assembly according to claim 2, wherein at least one of the plurality of connector openings includes at least one connector opening stress-relief groove in the second-side surface about the at least one of the plurality of connector openings.

4. The dome-deflector assembly according to claim 3, wherein the at least one connector opening stress-relief groove comprises a spiral groove extending about the at least one of the plurality of connector openings.

5. The dome-deflector assembly according to claim 3, wherein the at least one connector opening stress-relief groove includes a plurality of concentric circular grooves extending about the at least one of the plurality of connector openings.

6. The dome-deflector assembly according to claim 1, wherein the plurality of circumferential grooves are arranged concentric to one another with respect to the deflector-side swirler opening centerline axis.

7. The dome-deflector assembly according to claim 6, wherein the plurality of circumferential grooves includes a first circumferential groove having a first radius with respect to the deflector-side swirler opening centerline axis, a second circumferential groove having a second radius greater than the first radius with respect to the deflector-side swirler opening centerline axis, and a third circumferential groove having a third radius greater than the second radius with respect to the deflector-side swirler opening centerline axis.

8. The dome-deflector assembly according to claim 1, wherein the deflector portion has a thickness (t), and each of the plurality of circumferential grooves has a depth (d) from the second-side surface, and a ratio $t/d<2$.

* * * * *